US008820888B2

(12) United States Patent
Hayashi et al.

(10) Patent No.: US 8,820,888 B2
(45) Date of Patent: Sep. 2, 2014

(54) FLUID EJECTING APPARATUS

(75) Inventors: Takato Hayashi, Minowa-machi (JP); Hisashi Miyazawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 168 days.

(21) Appl. No.: 12/938,540

(22) Filed: Nov. 3, 2010

(65) Prior Publication Data

US 2011/0102500 A1 May 5, 2011

(30) Foreign Application Priority Data

Nov. 4, 2009 (JP) ..... 2009-252768
Jan. 25, 2010 (JP) ..... 2010-012983

(51) Int. Cl.
*B41J 2/165* (2006.01)
*B41J 2/17* (2006.01)

(52) U.S. Cl.
CPC ..... *B41J 2/16526* (2013.01); *B41J 2/16508* (2013.01); *B41J 2002/1742* (2013.01); *B41J 2/1721* (2013.01)
USPC ..... 347/31

(58) Field of Classification Search
None
See application file for complete search history.

(56) References Cited

U.S. PATENT DOCUMENTS

| | | | | |
|---|---|---|---|---|
| 7,562,961 | B2 | 7/2009 | Inoue | |
| 7,661,811 | B2 * | 2/2010 | Yoda | 347/104 |
| 2002/0044168 | A1 * | 4/2002 | Hashi et al. | 347/32 |
| 2005/0078145 | A1 * | 4/2005 | Inoue | 347/31 |
| 2010/0118084 | A1 | 5/2010 | Seshimo | |
| 2011/0012956 | A1 * | 1/2011 | Kagata et al. | 347/29 |

FOREIGN PATENT DOCUMENTS

| | | |
|---|---|---|
| JP | 10-309810 | 11/1998 |
| JP | 10-337885 | 12/1998 |
| JP | 2003-182102 | 7/2003 |
| JP | 2005-022305 | 1/2005 |
| JP | 2005-119284 | 5/2005 |
| JP | 2006-116808 | 5/2006 |

* cited by examiner

*Primary Examiner* — Alejandro Valencia
(74) *Attorney, Agent, or Firm* — Workman Nydegger

(57) ABSTRACT

Provided is a fluid ejecting apparatus including: a plurality of nozzle rows which is arranged in the direction intersecting the extension direction of nozzles; a linear absorbing member which is suspended while being parallel to the nozzle rows or inclined with respect to the nozzle rows at a predetermined angle; a first movement section which relatively moves at least one of the absorbing member and the nozzle rows in the direction intersecting the nozzle rows; and a control section which performs a flushing process in which a fluid is selectively ejected from the nozzles facing the absorbing member toward the absorbing member while moving the absorbing member using the first movement section.

9 Claims, 12 Drawing Sheets

FLUID EJECTING APPARATUS

CROSS REFERENCES TO RELATED APPLICATIONS

The entire disclosure of Japanese Patent Application Nos. 2009-252768, filed Nov. 4, 2009, 2010-012983, filed Jan. 25, 2010, are expressly incorporated by reference herein.

BACKGROUND

1. Technical Field

The present invention relates to a fluid ejecting apparatus, and particularly, to a flushing process of a printing head.

2. Related Art

An ink jet printer (hereinafter, referred to as "a printer") is widely known as a fluid ejecting apparatus which ejects ink droplets onto a printing sheet (medium). In this kind of printer, since ink evaporates from a nozzle of a printing head, ink in the nozzle is thickened or solidified, dust is attached to the nozzle, and bubbles are mixed with the ink in the nozzle, which causes an erroneous printing process. Therefore, generally, in a printer, in addition to an ejection process of ejecting ink to a printing sheet, a flushing process of compulsorily ejecting ink in the nozzle to the outside is performed.

In a scanning-type printer, the flushing process is performed by moving a printing head to an area other than a printing area. However, in a printer including a line head in which a printing head is fixed, the printing head cannot move during a flushing process. Therefore, for example, JP-A-2005-119284 proposes a method of ejecting ink toward absorbing members provided in a surface of a sheet transporting belt.

However, in the method disclosed in JP-A-2005-119284, since the plural absorbing members are arranged at the same interval on the sheet transporting belt in accordance with the size of the printing sheet, problems arise in that ink needs to be ejected in every gap between the printing sheets during the flushing process, and in that the size or transporting speed of the printing sheet is limited. In addition, when the flushing process is performed on a planar absorbing member, ink is scattered in the form of a mist due to a wind pressure caused by an operation of ejecting ink droplets, which may contaminate the printing sheet or the sheet transporting belt.

SUMMARY

An advantage of some aspects of the invention is that it provides a fluid ejecting apparatus capable of simply performing a cleaning (flushing) process within a short time.

In order to solve the above-described problem, some aspects of the invention provide the fluid ejecting apparatus as below.

A fluid ejecting apparatus of the invention includes: a plurality of nozzle rows which is arranged in the direction intersecting the extension direction of nozzles; a linear absorbing member which is suspended while being parallel to the nozzle rows or inclined with respect to the nozzle rows at a predetermined angle; a first movement section which relatively moves at least one of the absorbing member and the nozzle rows in the direction intersecting the nozzle rows; and a control section which performs a flushing process in which a fluid is selectively ejected from the nozzles facing the absorbing member toward the absorbing member while moving the absorbing member using the first movement section.

The number of absorbing members may be fewer than the number of nozzle rows.

The fluid ejecting apparatus may further include: a detection section which detects the nozzles facing the absorbing member, wherein the control section may control the ejection of each of the nozzles during the flushing process on the basis of ejection timing data created in advance by the detection section and storing the ejection timing for each of the nozzles.

The fluid ejecting apparatus may further include: a detection section which detects the nozzles facing the absorbing member, wherein the control section may output position information of the nozzles sequentially facing the absorbing member during the flushing process, and wherein the control section may selectively eject the fluid only from the nozzles facing the absorbing member on the basis of the position information output from the detection section in real time.

The fluid ejecting apparatus may further include: a second movement section which moves the absorbing member in the suspension direction thereof.

The second movement section may include a rotation body capable of winding the absorbing member thereon.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
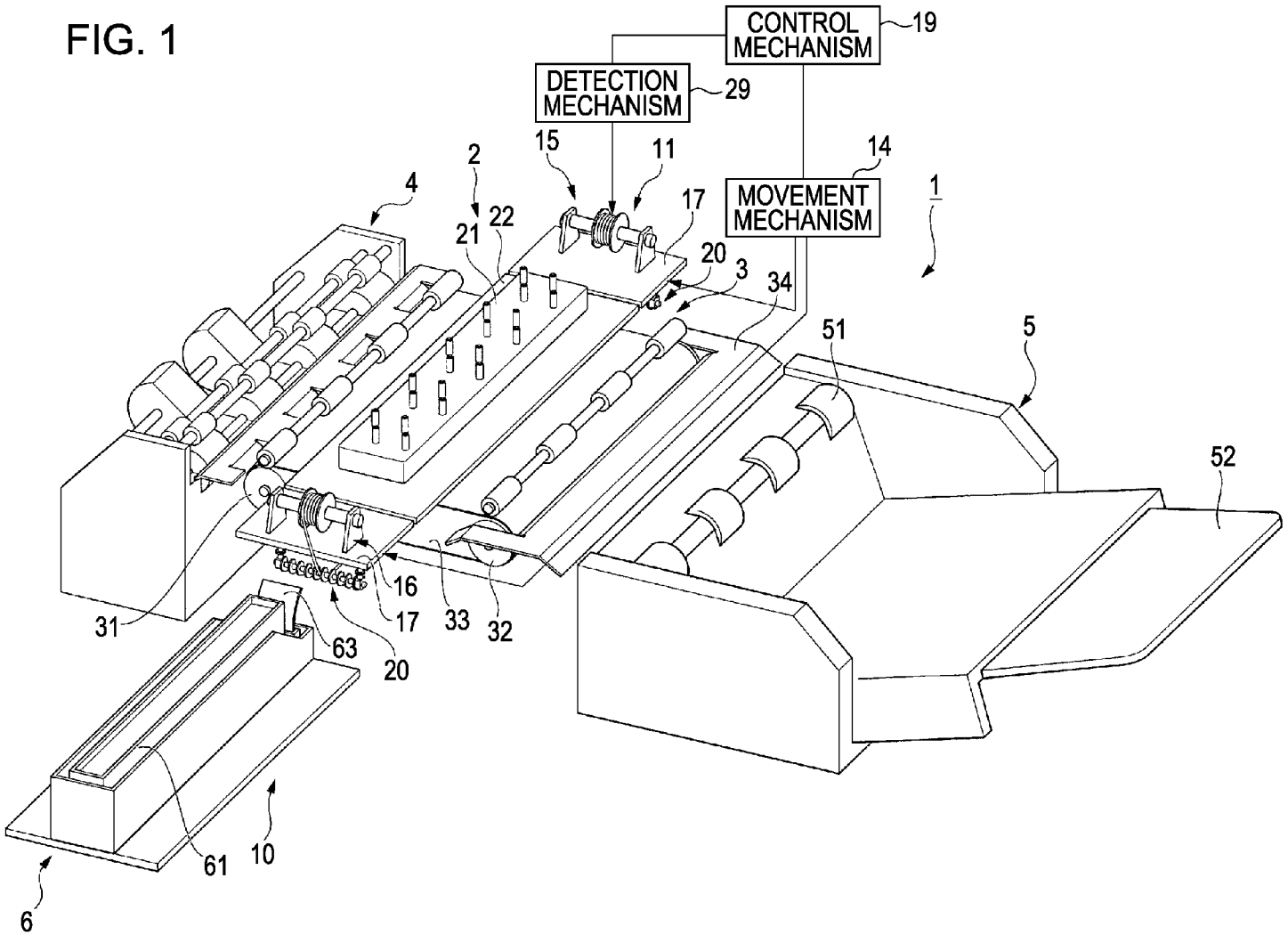
FIG. 1 is a perspective view illustrating a schematic configuration of a printer (a fluid ejecting apparatus) according to a first embodiment of the invention.

Hereinafter, an embodiment of a fluid ejecting apparatus according to the invention will be described with reference to the accompanying drawings. Further, in the drawings below, the scales of the respective members are appropriately changed so that the respective members have recognizable sizes. Furthermore, in the description below, an ink jet printer (hereinafter, simply referred to as a printer) as an example of the fluid ejecting apparatus of the invention will be described.

FIG. 1 is a perspective view illustrating a schematic configuration of a printer 1 of this embodiment of the invention. As shown in this drawing, the printer 1 of this embodiment includes a head unit 2, a transportation device 3 which transports a printing sheet (medium), a sheet feeding unit 4 which supplies the printing sheet, a sheet discharging unit 5 which discharges the printing sheet printed by the head unit 2, and a maintenance device 10 which performs a maintenance process on the head unit 2.

The transportation device 3 holds the printing sheet while having a predetermined gap with respect to the nozzle surface 23 (refer to FIG. 2) of the printing head 21 constituting the head unit 2. The transportation device 3 includes a driving roller portion 31, a driven roller portion 32, and a transportation belt portion 33 which is formed by a plurality of belts wound around the roller portions 31 and 32. In addition, a holding member 34 for holding the printing sheet is installed between the sheet discharging unit 5 and the downstream side (the side of the sheet discharging unit 5) of the transportation direction of the printing sheet of the transportation device 3.

One end of the driving roller portion 31 in the rotation direction is connected to a driving motor (not shown), and is rotationally driven by the driving motor. The rotation force of the driving roller portion 31 is transmitted to the transporting belt portion 33, so that the transporting belt portion 33 is rotationally driven. If necessary, a transmission gear is provided between the driving roller portion 31 and the driving motor. The driven roller portion 32 is a so-called free roller which supports the transporting belt portion 33 and is rotated by the rotational driving operation of the transporting belt portion 33 (the driving roller portion 31).

The sheet discharging unit 5 includes a sheet discharging roller 51 and a sheet discharging tray 52 which holds the printing sheet transported by the sheet discharging roller 51.

Figure 2:
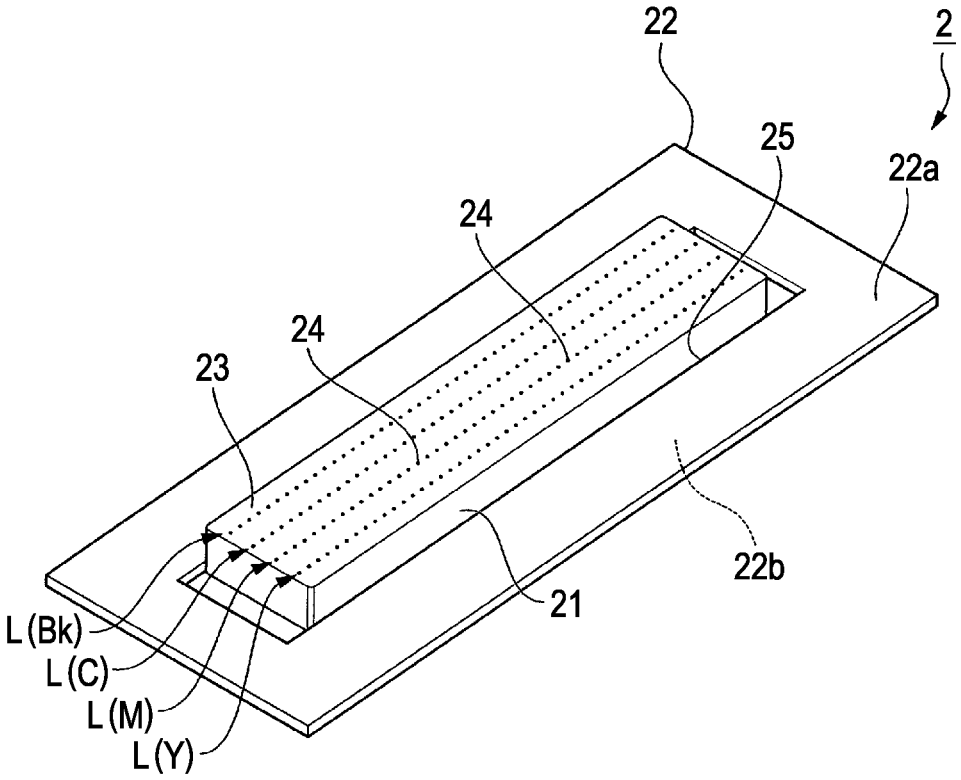
FIG. 2 is a perspective view illustrating a lower surface side of a head unit provided in the printer of the first embodiment of the invention.

FIG. 2 is a perspective view illustrating the lower surface side of the head unit 2. As shown in this drawing, the head unit 2 includes a linear printing head 21 (fluid ejecting head) and an attachment plate 22 supporting the printing head 21.

The printing head 21 is formed in accordance with the effective printing width of the head unit 2, and includes a plurality of nozzles 24 ejecting ink. In addition, the nozzles 24 ejecting the same kind (for example, black B, magenta M, yellow Y, and cyan C) of ink are arranged in the extension direction of the printing head 21 to thereby form one nozzle row L. That is, the printer 1 of this embodiment includes the printing head 21 having nozzle rows L formed by the plurality of nozzles 24 ejecting ink.

In more detail, the printing head 21 has four nozzle rows (L(Y), L(M), L(C), and L(Bk)) corresponding to four colors (yellow (Y), magenta (M), cyan (C), and black (Bk)). As for each of the nozzle rows (L(Y), L(M), L(C), and L(Bk)), the nozzles 24 forming the corresponding nozzle rows (L(Y), L(M), L(C), and L(Bk)) are arranged in the horizontal direction intersecting the transportation direction of the printing sheet, and more desirably arranged in the horizontal direction perpendicular to the transportation direction of the printing sheet.

As shown in FIG. 2, the head unit 2 has a structure in which the printing head 21 is disposed inside an opening 25 formed in the attachment plate 22. In detail, the printing head 21 is fixed to a rear surface 22*b* of the attachment plate 22 by the use of a screw, so that the nozzle surface 23 protrudes from a front surface 22*a* of the attachment plate 22 via the opening 25. In addition, since the attachment plate 22 is fixed to a carriage (not shown), the head unit 2 is adapted to be movable to a maintenance position to be described later.

The head unit 2 of this embodiment is adapted to be movable between the printing position and the maintenance position by the use of a carriage (not shown). Here, the printing position is a position where the head unit performs a printing process on the printing sheet while facing the transportation device 3. On the other hand, the maintenance position is a position where the head unit faces a cap unit 6 (refer to FIG. 1) provided in the maintenance device 10 at a position retreating from the upper side of the transportation device 3. The maintenance process (a suction process and a wiping process) for the head unit 2 is performed at the maintenance position.

Returning to FIG. 1, the maintenance device 10 includes the cap unit 6 which performs the suction process on the head unit 2, and a flushing unit 11 which performs a flushing process on the head unit 2.

The cap unit 6 performs the maintenance process such as a capping or suction process on the head unit 2, and includes a cap portion 61 corresponding to the printing head 21. The cap unit 6 is disposed at a position deviated from a printing area of the head unit 2.

The cap portion 61 is adapted to come into contact with the nozzle surface 23 of the printing head 21. Since the cap portion 61 comes into close contact with the nozzle surface 23 of the printing head 21, it is possible to perform a satisfactory capping process, and also to perform a satisfactory suction process of discharging ink from the nozzle surface 23.

In addition, as shown in FIG. 1, the cap unit 6 includes a wiper member 63 which is used in a wiping process of wiping the nozzle surface 23 of the printing head 21.

Figure 3:
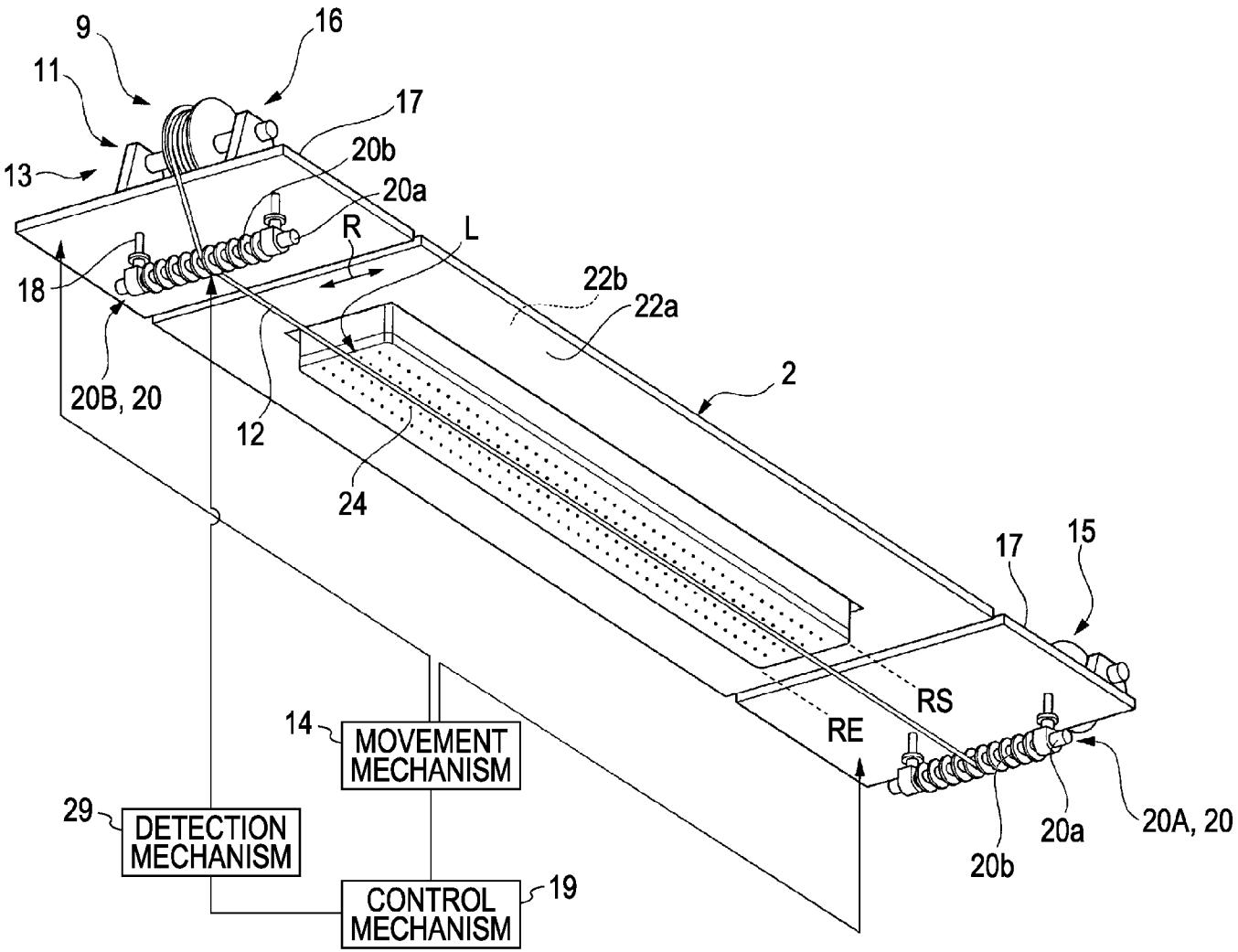
FIG. 3 is a perspective view illustrating the head unit and the flushing unit provided in the printer of the first embodiment of the invention when seen from the lower side thereof.

FIG. 3 is a perspective view illustrating the head unit 2 and the flushing unit 11 when seen from the transportation device 3. In addition, FIG. 4 is a schematic diagram illustrating the head unit 2 and the flushing unit 11 when seen from the transportation direction of the printing sheet.

Figure 4:
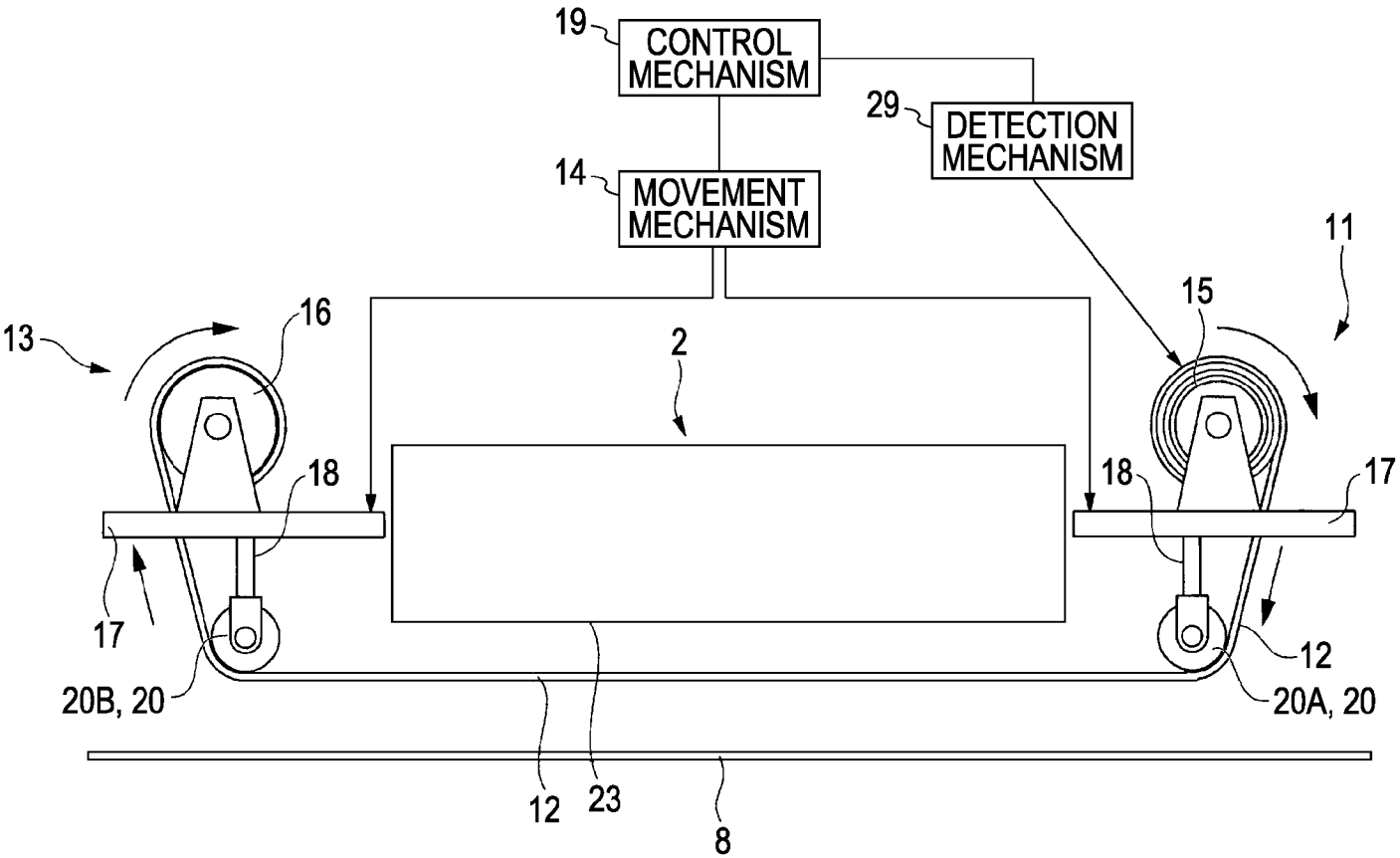
FIG. 4 is a schematic diagram illustrating the head unit and the flushing unit provided in the printer of the first embodiment of the invention when seen from the transportation direction of the printing sheet.

As shown in FIGS. 3 and 4, the flushing unit 11 includes an absorbing member 12 which absorbs the ink ejected during the flushing process and a support mechanism 9 which supports the absorbing member 12.

The absorbing member 12 is a linear member which absorbs the ink ejected from each of the nozzles 24, and extends along the nozzle rows (L(Y), L(M), L(C), and L(Bk)), formed by arranging the nozzles 24 of respective colors, so as to be located between the nozzle surface 23 and the transportation area of the printing sheet.

Then, in the printer 1 of the embodiment, only one absorbing member 12 is provided. That is, the number of the absorbing members 12 is fewer than the number of the nozzle rows L.

Next, the detailed configuration of the absorbing member 12 suitably used in the printer 1 according to this embodiment will be described.

For example, the absorbing member 12 may be formed of a fiber such as SUS 304, nylon, nylon applied with a hydrophobic coating, aramid, silk, cotton, polyester, ultrahigh molecular weight polyethylene, polyarylate, or Zylon (product name), or compound fiber containing a plurality of these.

In more detail, it is possible to form the absorbing member 12 in such a manner that plural fiber bundles formed of the fiber or the compound fiber are twisted or bound.

Figure 5A:
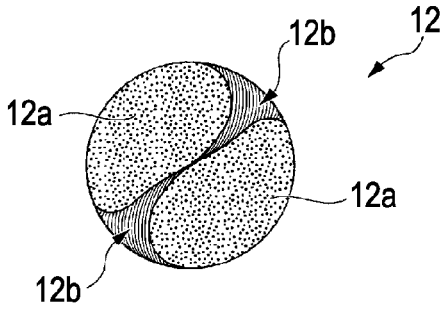
FIGS. 5A and 5B are schematic diagrams illustrating an example of an absorbing member provided in the printer of the first embodiment of the invention.
Figure 5B:
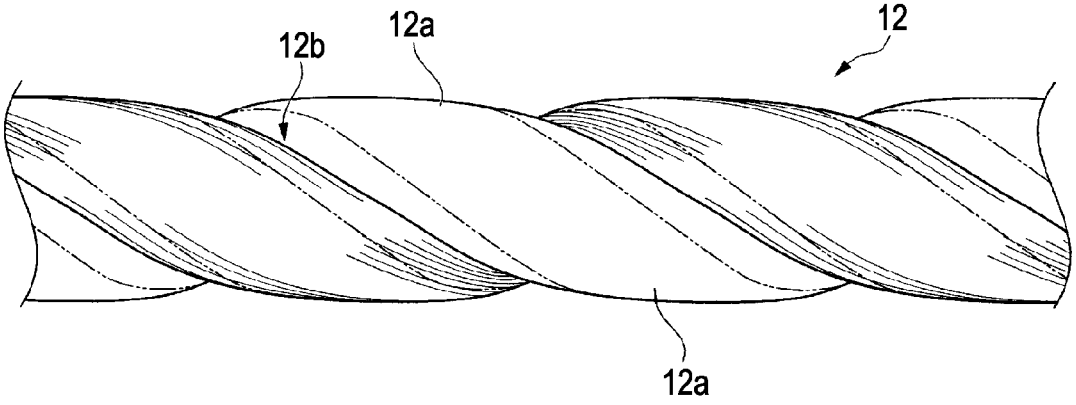

FIGS. 5A and 5B are schematic diagrams showing an example of the absorbing member 12, where FIG. 5A is a sectional view and FIG. 5B is a plan view. As shown in FIGS.

5A and 5B, for example, the absorbing member 12 is formed in such a manner that two (plural) fiber bundles (strings) 12*a* formed of fiber are twisted. As shown in FIGS. 5A and 5B, in the case where the absorbing member 12 is formed by twisting the plural fiber bundles 12*a*, since it is possible to store ink in a valley portion 12*b* formed between the fiber bundles 12*a*, it is possible to increase an ink absorption amount of the absorbing member 12.

In addition, as an example, a linear member obtained by twisting plural fiber bundles formed of SUS 304, a linear member obtained by twisting plural fiber bundles formed of nylon, a linear member obtained by twisting plural fiber bundles formed of nylon applied with hydrophobic coating, a linear member obtained by twisting plural fiber bundles formed of aramid, a linear member obtained by twisting plural fiber bundles formed of silk, a linear member obtained by twisting plural fiber bundles formed of cotton, a linear member obtained by twisting plural fiber bundles formed of Belima (product name), a linear member obtained by twisting plural fiber bundles formed of Soierion (product name), a linear member obtained by twisting plural fiber bundles formed of Hamilon 03 T (product name), a linear member obtained by twisting plural fiber bundles formed of Dyneema hamilon DB-8 (product name), a linear member obtained by twisting plural fiber bundles formed of Vectran hamilon VB-30, a linear member obtained by twisting plural fiber bundles formed of Hamilon S-5 Core Kevlar Sleeve Polyester (product name), a linear member obtained by twisting plural fiber bundles formed of Hamilon S-212 Core Coupler Sleeve Polyester (product name), a linear member obtained by twisting plural fiber bundles formed of Hamilon SZ-10 Core Zylon Sleeve Polyester (product name), or a linear member obtained by twisting plural fiber bundles formed of Hamilon VB-3 Vectran (product name) may be suitably used as the absorbing member 12.

Since the absorbing member 12 obtained by the fiber of nylon is formed of nylon widely used as a general leveling string, the absorbing member 12 is cheap.

Since the absorbing member 12 using the metallic fiber of SUS has an excellent corrosion resistance property, it is possible to allow the absorbing member 12 to absorb a variety of ink. Also, since the absorbing member 12 has an excellent wear resistance property compared with a resin, it is possible to repeatedly use the absorbing member 12.

The absorbing member 12 using the fiber of ultrahigh molecular weight polyethylene has high breaking strength and chemical resistance, and is strong against an organic solvent, acid, or alkali. Likewise, since the absorbing member 12 using the fiber of ultrahigh molecular weight polyethylene has high breaking strength, it is possible to pull the absorbing member 12 in a high-tension state, and to prevent the absorbing member 12 from being bent. For this reason, in the case where the diameter of the absorbing member 12 is thickened so as to increase the absorbing capacity or the diameter of the absorbing member 12 is not thickened, it is possible to improve the printing precision by narrowing the distance between the printing sheet transporting region and the head 21. In addition, it is expected that the above-described advantage is obtained even in the absorbing member 12 using the fiber of Zylon or an aramid and the absorbing member 12 using the fiber of super-high-molecular polyethylene.

The absorbing member 12 using the fiber of cotton has an excellent ink absorbing property.

In the absorbing member 12, the dropped ink is accommodated and absorbed in the valley portion 12*b* (see FIGS. 5A and 5B) formed between the fiber bundle 12*a* and the fiber due to the surface tension.

In addition, a part of the ink dropped onto the surface of the absorbing member 12 directly enters into the absorbing member 12, and the rest moves to the valley portion 12*b* formed between the fiber bundles 12*a*. Further, a part of the ink entering into the absorbing member 12 gradually moves in the extension direction of the absorbing member 12 in the inside of the absorbing member 12 so as to be held therein while being dispersed in the extension direction of the absorbing member 12. A part of the ink moving to the valley portion 12*b* of the absorbing member 12 gradually enters into the absorbing member 12 through the valley portion 12 *b*, and the rest remains in the valley portion 12*b* so as to be held therein while being dispersed in the extension direction of the absorbing member 12. That is, a part of the ink dropped onto the surface of the absorbing member 12 stays at the dropped position, and the rest is dispersed and absorbed in the vicinity of the dropped position.

In addition, in fact, a material forming the absorbing member 12 provided in the printer 1 is selected in consideration of an ink absorbing property, an ink holding property, a tensile strength, an ink resistance property, formability (a generated amount of fluff or fraying), distortion, cost, or the like.

Further, the ink absorbing amount of the absorbing member 12 is the sum of the amount of ink held between the fibers of the absorbing member 12 and the amount of ink held in the valley portion 12*b*. For this reason, the material forming the absorbing member 12 is selected so that the ink absorbing amount is sufficiently larger than the amount of the ink ejected during the flushing process in consideration of the exchange frequency of the absorbing member 12.

Furthermore, the amount of ink held between the fibers of the absorbing member 12 and the amount of ink held in the valley portion 12*b* may be determined by the contact angle between the ink and the fibers, and the capillary force between the fibers depending on the surface tension of the ink. That is, when the absorbing member 12 is formed of thin fibers, the gap between the fibers increases and the surface area of the fiber increases. Accordingly, even when the sectional area of the absorbing member 12 is uniform, the absorbing member 12 is capable of absorbing a larger amount of ink. As a result, in order to obtain more gaps between the fibers, a micro fiber (ultrafine fiber) may be used as a fiber forming the fiber bundle 12*a*.

However, the ink holding force of the absorbing member 12 decreases since the capillary force decreases due to an increase in the gap between the fibers. For this reason, it is necessary to set the gap between the fibers so that the ink holding force of the absorbing member 12 is of a degree that the ink is not dropped due to the movement of the absorbing member 12.

In addition, the thickness of the absorbing member 12 is set so as to satisfy the above-described ink absorbing amount. In detail, for example, the thickness of the absorbing member 12 is set to be equal to or more than 0.3 mm and equal to or less than 1.0 mm, and more desirably about 0.5 mm.

However, in order to prevent the absorbing member 12 from coming into contact with the head 21 and the printing sheet, the thickness of the absorbing member 12 is set so that the maximum dimension of the section is equal to or less than a dimension obtained by subtracting an amount excluding the displacement amount caused by the bending of the absorbing member 12 from the distance of the sheet transporting region between the printing sheet and the head 21.

In addition, the absorbing member 12 has a width which is larger than the diameter of the nozzle by 15 to 50 times. In this embodiment, the gap between the printing sheet and the nozzle surface 23 of the printing head 21 is about 2 mm, and the nozzle diameter is about 0.02 mm. Accordingly, when the diameter of the absorbing member 12 is 1 mm or less, the absorbing member can be disposed between the nozzle surface and the printing sheet, and the ejected ink can be captured by the absorbing member even when component dimension errors are considered.

In addition, the cross-sectional shape of the absorbing member 12 may not be formed in a circular shape, but may be formed in a polygonal shape or the like. Here, since it is difficult to form the absorbing member in a perfect circular shape, the circular shape includes a substantially circular shape.

Further, it is desirable that the length of the absorbing member 12 is sufficiently long with respect to the effective printing width of the head unit 2. Although it will be described in detail, the printer 1 of the embodiment adopts a configuration in which the used area (ink absorbing state) of the absorbing member 12 is sequentially wound, and the absorbing member 12 is exchanged with a new replacement when the entire area of the absorbing member 12 absorbs the ink. For this reason, it is desirable that the exchange period of the absorbing member 12 is set to a period where the absorbing member can be used practically, and the length of the absorbing member 12 is about several hundred times that of the effective printing width of the head unit 2. However, when the absorbing member 12 is recycled by performing a cleaning process or the like in the printer 1, the length of the absorbing member 12 may be twice as long as the effective printing width of the head unit 2.

The absorbing member 12 is suspended (supported) by the support mechanism 9 so as to be parallel to the extension direction of the nozzle row L.

As shown in FIGS. 3 and 4, the support mechanism 9 includes a winding mechanism (a second movement section) 13 and a movement mechanism (a first movement section) 14.

The movement mechanism 14 (the first movement section) is adapted to move the absorbing member 12 between the flushing position facing the nozzle 24 and the retreat position not facing the nozzle 24 by moving the absorbing member 12 in the direction (in the embodiment, perpendicular to) intersecting the extension direction of the nozzle row. Further, the winding mechanism 13 (the second movement section) is adapted to move the absorbing member 12 in the extension direction by supplying or winding the absorbing member 12.

As shown in FIGS. 3 and 4, the winding mechanism (the second movement section) 13 includes rotation portions 15 and 16 which are respectively provided on the side of the rear surface 22*b* of the attachment plate 22 (the opposite side of the nozzle surface 23 in the printing head 21) on both sides of the head unit 2 in the nozzle extension direction so that their rotation shafts are aligned with the transportation direction of the printing sheet. As described later, one (in the embodiment, the rotation portion 15) of the rotation portions 15 and 16 is adapted to supply the absorbing member 12, and the other (in the embodiment, the rotation portion 16) is adapted to wind the absorbing member 12. Accordingly, the winding mechanism 13 is adapted to move the absorbing member 12 as described above by the combination of both actual operations of "supplying" and "winding". The rotation portions 15 and 16 are installed on the support plate 17 that is installed inside the casing of the printer 1.

In the winding mechanism 13 and the movement mechanism 14, the movement amount or the movement speed is appropriately controlled by a control mechanism (a control section) 19. Further, a detection mechanism (a detection section) 29 is connected to the control mechanism 19. The detection mechanism 29 is configured as a device detecting the movement amount of the winding mechanism 13, for example, a linear encoder or the like. The detection mechanism 29 detects in real time a position where the absorbing member 12 is located in the direction intersecting the extension direction of the nozzle row during the flushing process to be described later, and transmits the position signal (the position information) to the control mechanism 19.

The rotation portions 15 and 16 are connected to a driving motor (not shown), and the absorbing member 12 is supplied and wound by the rotation thereof. In the embodiment, one rotation portion 15 is used to supply the absorbing member, and the other rotation portion 16 is used to wind the absorbing member. Then, the rotation portions 15 and 16 are detachably attached to the printer 1.

The movement mechanism 14 moves the absorbing member 12 in the transportation direction of the printing sheet (the direction perpendicular to the extension direction of the nozzle row) in the rotation portions 15 and 16 by supporting the support plate 17 and moving the support plate 17 in the transportation direction of the printing sheet. As the movement mechanism 14, for example, a linear slide device may be used.

Further, the support mechanism 9 includes pulleys 20 which are axially supported to the rear surface of the support plate 17 (the surface opposite to the surface provided with the rotation portions 15 and 16).

Each of the pulleys 20 has a structure in which a projection portion 20*b* is wound on a shaft portion 20*a* in a spiral shape, and is installed on the support plate 17 (pulleys 20A and 20B). Then, the absorbing member 12 is held inside a guide groove formed by the shaft portion 20*a* and the projection portion 20*b*.

Here, when the pulleys 20A and 20B each having a structure in which the projection portion 20*b* is wound on the shaft portion in a spiral shape are used, as the movement mechanism 14, a configuration may be adopted which rotates the pulleys 20A and 20B instead of a configuration in which the support plate 17 is moved in the transportation direction of the printing sheet. That is, when the pulleys 20A and 20B are rotated in this way, the absorbing member 12 is moved in the transportation direction of the printing sheet (in the direction perpendicular to the extension direction of the nozzle row) via the groove formed by the projection portion 20*b* wound on the shaft portion in a spiral shape. Accordingly, it is possible to move the absorbing member 12 by a desired distance in the transportation direction of the printing sheet by controlling the number of revolutions of the pulleys 20A and 20B.

Further, in the embodiment, since only one absorbing member 12 is suspended between the pulleys 20A and 20B, a structure in which at least one groove is formed on the pulleys 20A and 20B may be used instead of the structure in which the projection portion 20*b* is wound on the shaft portion in a spiral shape. Of course, even when a plurality of the absorbing members 12 is suspended between the pulleys, a structure may be used in which the number of grooves is equal to the number of the suspended absorbing members 12, as the pulleys 20A and 20B.

As shown in FIGS. 3 and 4, the pulleys 20A and 20B are installed on the support plate 17 via shaft support portions 18, and are disposed on the side of the front surface 22*a* of the attachment plate 22 (the nozzle surface 23 of the printing head 21) on both sides of the head unit 2 in the nozzle extension direction. The plurality of absorbing members 12 wound on the rotation portions 15 and 16 of the movement mechanism 13 is suspended between the pulleys 20A and 20B. Also, the end portion of the guide groove 20*c* perpendicular to the nozzle surface 23 is located in a direction away from the nozzle surface 23 with respect to the nozzle surface 23. For this reason, the absorbing members 12 suspended on the pulleys 20A and 20B are maintained without contacting the nozzle surface 23 of the printing head 21.

That is, the pulleys 20A and 20B serve as positioning members that uniformly maintain a distance between the absorbing member 12 and the nozzle surface 23 of the printing head 21.

Further, it is not desirable to directly dispose the rotation portions 15 and 16 at the positions of the pulleys 20A and 20B without providing the pulleys 20A and 20B since the position of the absorbing member 12 deviates from the position of the nozzle surface 23 as the absorbing member 12 moves between the rotation portions 15 and 16. That is, in the absorbing member 12 supplied from the rotation portion 15 and wound on the rotation portion 16, the supplying position or the winding position thereof changes even in the axial direction and the direction perpendicular to the shaft (the thickness direction) on the rotation portion 15 (16) as the absorbing member 12 moves between the rotation portions 15 and 16. Then, since the supplying position or the winding position changes in this manner, the position of the absorbing member 12 with respect to the nozzle surface 23 in the horizontal direction or the vertical direction changes.

Then, since a control device (not shown) controls the rotation speed of the rotation portions 15 and 16, the support mechanism 9 holds the absorbing member 12 in an appropriate tension state without bending the absorbing member. Accordingly, it is possible to prevent the absorbing member 12 from being bent and thereby contacting the nozzle surface 23 or the printing sheet.

In the support mechanism 9, since the absorbing member 12 is supported by the rotation portions 15 and 16 disposed on the support plate 17 and the pulleys 20A and 20B disposed on the front surface 22*a* of the attachment plate 22, the absorbing member 12 supplied from the rotation portion 15 is wound on the rotation portion 16 via a position facing the nozzle surface 23 of the printing head 21 (between the nozzle surface 23 and the transportation belt 33). For this reason, the absorbing member 12 is moved in the extension direction of the nozzle rows L of the head unit 2, that is, the direction intersecting the transportation direction of the printing sheet in accordance with the rotation of the rotation portions 15 and 16.

Further, since the support plate 17 is moved by the movement mechanism 14 in the transportation direction of the printing sheet, it is possible to change the position of the absorbing member 12 with respect to the head unit 2 (the nozzle row L). Specifically, in the embodiment, as shown in FIG. 3, the absorbing member 12 moves (scans) at a constant speed while maintaining a predetermined gap with respect to the nozzle surface 23 between one end side RS and the other end side RE of the printing head 21 in the scanning direction R toward the direction intersecting the extension direction of the nozzle row L (hereinafter, referred to as the scanning direction R of the absorbing member 12). Accordingly, the absorbing member 12 sequentially faces all the nozzle rows L during one scanning.

In addition, as shown in FIGS. 6B to 6D and 7A, the flushing position indicates the position (the position on the flight path of the ink) where the ink ejected from the nozzle row L directly above the absorbing member can be absorbed by the absorbing member 12 during the flushing process while the absorbing member 12 faces (overlaps with the nozzle surface 23 in the vertical direction) each of the nozzle rows L (the plurality of nozzles 24 constituting the nozzle rows L). On the other hand, the retreat position of the absorbing member 12 indicates a position other than the flushing position, that is, a position where the absorbing member 12 deviates from the position facing each of the nozzle rows L. In addition, here, the nozzle row L and the absorbing member 12 face each other meaning not only that the center of the nozzle 24 overlaps with the center of the absorbing member 12 in a plan view, but also that the nozzle 24 is located within the width of the absorbing member 12 in a plan view. In this state, the ink ejected from the nozzle 24 can be absorbed by the absorbing member 12.

When the support plate 17 is moved by the movement mechanism 14 and the pulley 20 is moved, as shown in FIGS. 6A to 6D, 7A, and 7B, the absorbing member 12 moves along the scanning direction R of the absorbing member 12 during one scanning operation from one end side RS of the printing head 21 to the other end side RE thereof while alternately passing the flushing positions and the retreat positions at a constant speed without stopping on the way.

In the printer 1 of the embodiment, all operations are generally controlled by the control device 19, and the absorbing member 12 moves (scans) at a constant speed from one end side RS to the other end side RE in the scanning direction R during the flushing process. Then, the detection mechanism 29 normally outputs the position of the absorbing member 12 in the scanning direction R to the control device 19, and the control device 19 controls the flushing process performed on the nozzle row L facing the absorbing member 12.

Figure 8:
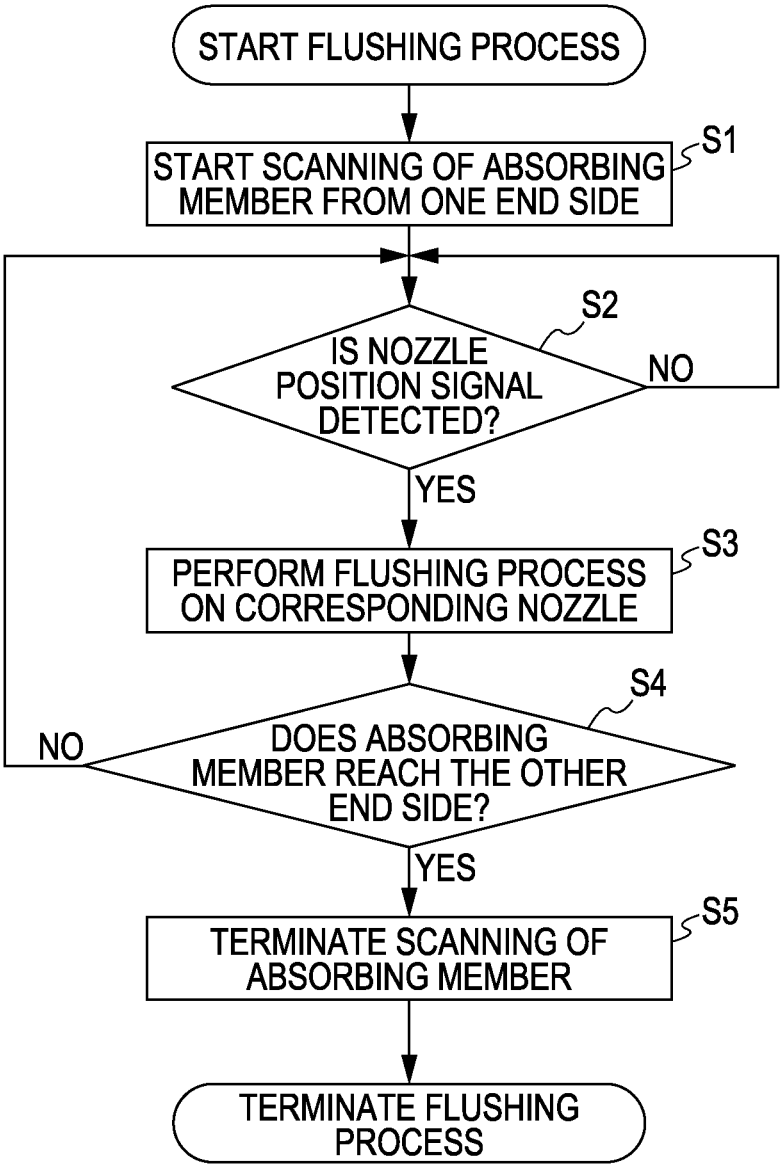
FIG. 8 is a flowchart illustrating the flushing process of the printer of the first embodiment of the invention.

FIG. 8 is a flowchart illustrating a control sequence of the flushing process.

Figure 6A:
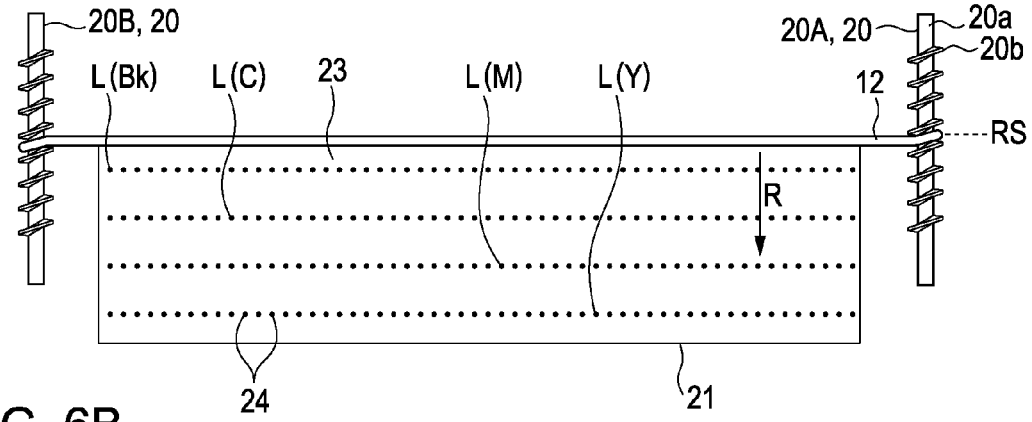
FIGS. 6A to 6D are explanatory diagrams illustrating a flushing process of the printer of the first embodiment of the invention.
Figure 6B:
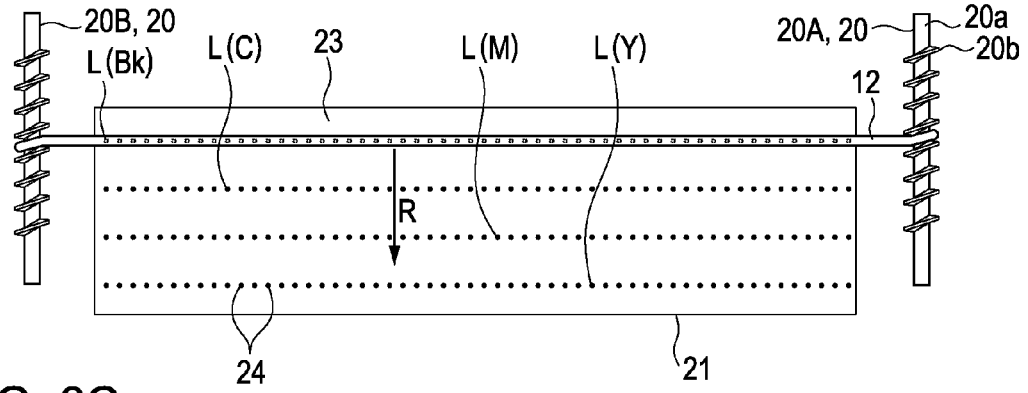

For example, as shown in FIG. 6A, the absorbing member 12 retreats to one end side RS (the retreat position) in the scanning direction R at the time other than the flushing process. Then, when it becomes the flushing mode, the absorbing member 12 moves (scans) at a constant speed from one end side RS to the other end side RE (refer to FIG. 7B) along the scanning direction R without stopping on the way (FIG. 8: S1). When it is detected that the absorbing member 12 reaches the position overlapping with the first row of the nozzle row L(Bk) among the nozzle rows L during the scanning operation of the absorbing member 12 on the basis of the position information obtained from the detection mechanism 29 as shown in FIG. 6B (FIG. 8: S2), the control device 19 conducts a control so that the flushing process is performed on the first row of the nozzle row L(Bk) using the absorbing member 12 moving along the scanning direction R (FIG. 8: S3). The absorbing member 12 absorbs the flushing fluid (ink) ejected from the first row of the nozzle row L(Bk).

Figure 6C:
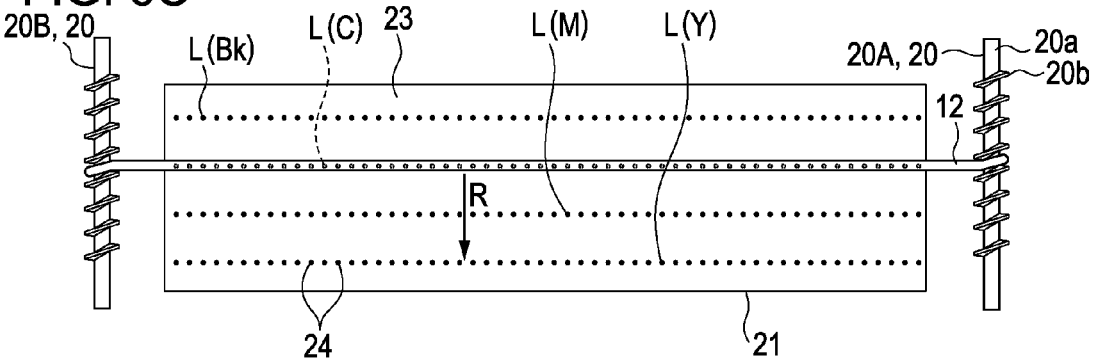

Subsequently, when it is detected that the absorbing member 12 reaches the position overlapping with the second row of the nozzle row L(C) among the nozzle rows L on the basis of the detection mechanism 29 as shown in FIG. 6C (FIG. 8: S2), the control device 19 conducts a control so that the flushing process is performed on the second row of the nozzle row L(C) using the absorbing member 12 moving along the scanning direction (FIG. 8: S3). The absorbing member 12 absorbs the flushing fluid (ink) ejected from the second row of the nozzle row L(C).

Figure 6D:
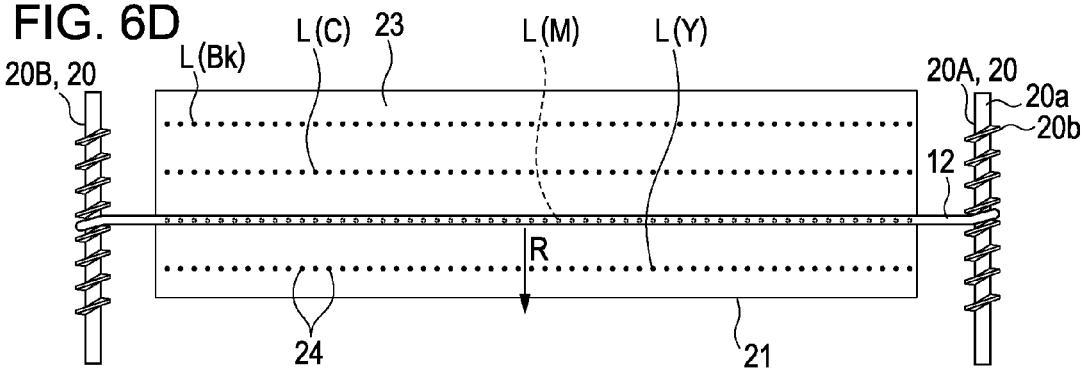

Further, when it is detected that the absorbing member 12 reaches the position overlapping with the third row of the nozzle row L(M) among the nozzle rows L on the basis of the detection mechanism 29 as shown in FIG. 6D, the control device 19 conducts a control so that the flushing process is performed on the third row of the nozzle row L(M) using the absorbing member 12 moving along the scanning direction. The absorbing member 12 absorbs the flushing fluid (ink) ejected from the third row of the nozzle row L(M).

Figure 7A:
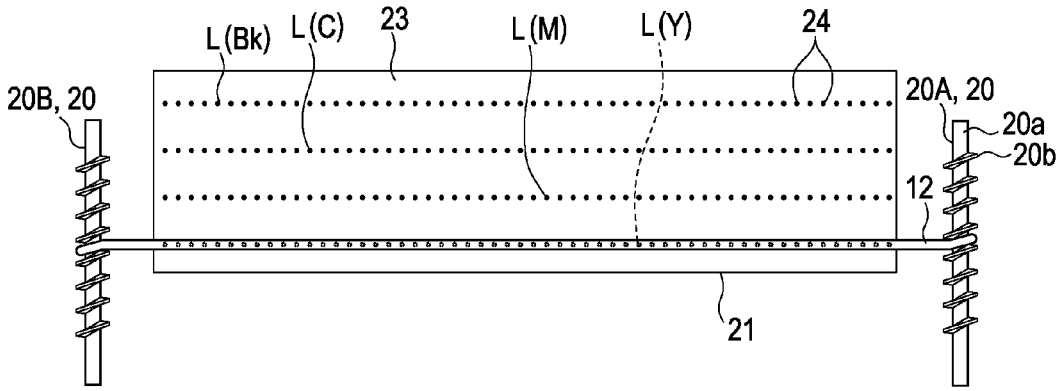
FIGS. 7A and 7B are explanatory diagrams illustrating the flushing process of the printer of the first embodiment of the invention.
Figure 7B:
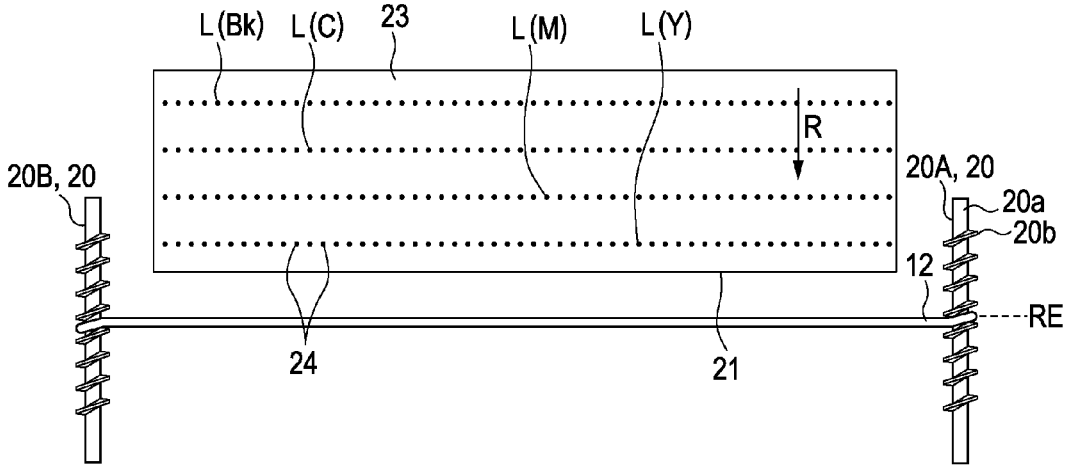

Then, when it is detected that the absorbing member 12 reaches the position overlapping with the fourth row of the nozzle row L(Y) among the nozzle rows L on the basis of the detection mechanism 29 as shown in FIG. 7A, the control device 19 conducts a control so that the flushing process is performed on the fourth row of the nozzle row L(Y) using the absorbing member 12 moving along the scanning direction. The absorbing member 12 absorbs the ink ejected from the fourth row of the nozzle row L(M). Subsequently, when the absorbing member 12 reaches the retreat position at the other end side RE in the scanning direction R as shown in FIG. 7B (FIG. 8: S4), the absorbing member 12 stops (FIG. 8: S5).

Further, in the scanning operation of the absorbing member 12 during the flushing process, when the winding mechanism 13 is driven while moving the absorbing member 12 in the scanning direction R, the absorbing member 12 is moved in the suspension direction (in the embodiment, the direction along the nozzle row L), thereby winding the fluid (ink) absorbing portion of the absorbing member 12. Accordingly, since the ink ejected from the nozzle rows (Bk), (C), (M), and (Y) is ejected to a new portion (not containing the ink) of the absorbing member 12, the ink is rapidly absorbed to the absorbing member 12.

It is desirable that the winding speed of the absorbing member 12 in the winding mechanism 13 is adjusted in accordance with the ink ejection amount, and the winding speed is increased so that the absorbing member 12 is not saturated when the ink ejection amount is large. Accordingly, the absorbing member is wound rapidly so as to prevent ink absorption leakage.

In addition, since the absorbing member 12 is wound by the winding mechanism 13, it is possible to absorb the absorbing member 12 using the entire area of the absorbing member 12, and thus to use the absorbing member 12 for a longer period of time without exchanging the absorbing member 12.

On the other hand, when the cross-sectional dimension of the absorbing member 12 can be ensured to be sufficiently large with respect to the nozzle diameter, the ink absorption amount of the absorbing member 12 increases. For this reason, the winding operation of the absorbing member 12 may not be performed while performing the flushing process. In this case, the fluid (ink) absorbing portion of the absorbing member 12 may be wound by driving the winding mechanism 13 so as to move the absorbing member 12 in the suspension direction after terminating the once movement (scanning) operation of the absorbing member 12 from one end side RS to the other end side RE. Accordingly, it is possible to reduce the usage amount of the absorbing member 12.

For example, it is desirable that the flushing process is performed between the printing sheets while continuously transporting the printing sheet using the transportation device 3. Accordingly, it is possible to perform the flushing process while continuously performing the printing process on plural printing sheets without specifically providing time for the flushing process.

In addition, it is desirable that the frequency of the flushing process for each of the nozzle rows L is the same. For this reason, it is desirable that a difference in the time for the absorbing member 12 passing below each of the nozzle rows L1 to L4 is minimal (desirably, zero). That is, it is desirable that the movement speed during the scanning operation of the absorbing member 12 is maintained to be constant.

Further, in the scanning operation of the absorbing member 12 during the flushing process, for example, the absorbing member 12 may move (scan) at a constant speed from one end side RS to the other end side RE in the scanning direction R during the first flushing process, and the absorbing member 12 may move (scan) at a constant speed from the other end side RE to the one end side RS during the second flushing process.

Furthermore, the flushing process may be performed only on the nozzle rows (Bk) and (C) during the first flushing process, and may be performed only on the nozzle rows (M) and (Y) during the second flushing process. Similarly, when the flushing process is performed while moving (scanning) the absorbing member 12, the absorbing member 12 may move (scan) with respect to the nozzle rows L in an arbitrary manner.

As described above, in the printer 1 of the embodiment, the flushing process is sequentially performed on the nozzle rows L located at a position overlapping with the absorbing member 12 while moving (scanning) the absorbing member 12 at a predetermined speed along the direction (the scanning direction R) intersecting the extension direction of the nozzle row L. Accordingly, compared with the method in which the absorbing member moves to the position overlapping with the nozzle row L during the flushing process and the flushing process is performed by stopping the absorbing member every time, it is possible to perform the flushing process on all nozzle rows within a short time without performing a complex control in which the absorbing member moves and stops at each of the nozzle rows.

In addition, when the thin absorbing member 12 moves and stops as in the invention, the absorbing member 12 vibrates greatly, and particularly, a part deviates from the position facing the nozzle row L in the vicinity of the center of the absorbing member 12. When the flushing process is performed while the absorbing member 12 vibrates, the ejected ink may not contact the absorbing member, and hence there is a possibility that the other parts may be contaminated. Alternatively, a certain time is spent waiting until the vibration stops, and the movement and the stop are repeated, whereby more time is spent. When the flushing process is performed while moving the absorbing member 12 as in the invention, it is possible to prevent the vibration of the absorbing member 12, and to prevent the ink from being attached to other parts. Also, it is not necessary to wait until the vibration stops.

For this reason, it is possible to perform the flushing process, for example, between the printing sheets while continuously transporting the printing sheet using the transportation device 3, and to efficiently perform the flushing process while continuously performing the printing process on the plural printing sheets without specifically providing time for the flushing process.

In addition, it is possible to perform the flushing process on all nozzle rows L using, for example, one absorbing member 12 (the number of absorbing members 12 is fewer than the number of nozzle rows) by moving the absorbing member 12 in the scanning direction R. Even when the absorbing member 12 is disposed between the printing head 21 and the transportation area of the printing sheet 8, it is possible to prevent the occurrence of jams caused by contact between the printing sheet 8 and the absorbing member 12 compared with the case where the number of the absorbing members 12 is equal to the number of the nozzle rows L.

Further, according to the printer 1 of the embodiment, since the number of the absorbing members 12 as the maintenance targets is fewer than that of the case where the number of the absorbing members 12 is equal to the number of the nozzle rows L, it is possible to reduce the space to which the absorbing member 12 retreats.

Furthermore, the winding mechanism 13 of the printer 1 of the embodiment includes the rotation portions 15 and 16 capable of winding the absorbing member 12 thereon and detachable from the printer 1. For this reason, it is possible to easily exchange the absorbing member 12 by exchanging the rotation portions 15 and 16 on which the absorbing member 12 is wound.

While the preferred embodiments of the invention are described as above with reference to the accompanying drawings, it is needless to say that the invention is not limited to the preferred embodiments, and the preferred embodiments may be combined with each other. It is apparent that various modifications and corrections can be made by persons skilled in the art within the scope of the technical spirit according to the claims, and it should be, of course, understood that the modifications and corrections are included in the technical scope of the invention.

Figure 9:
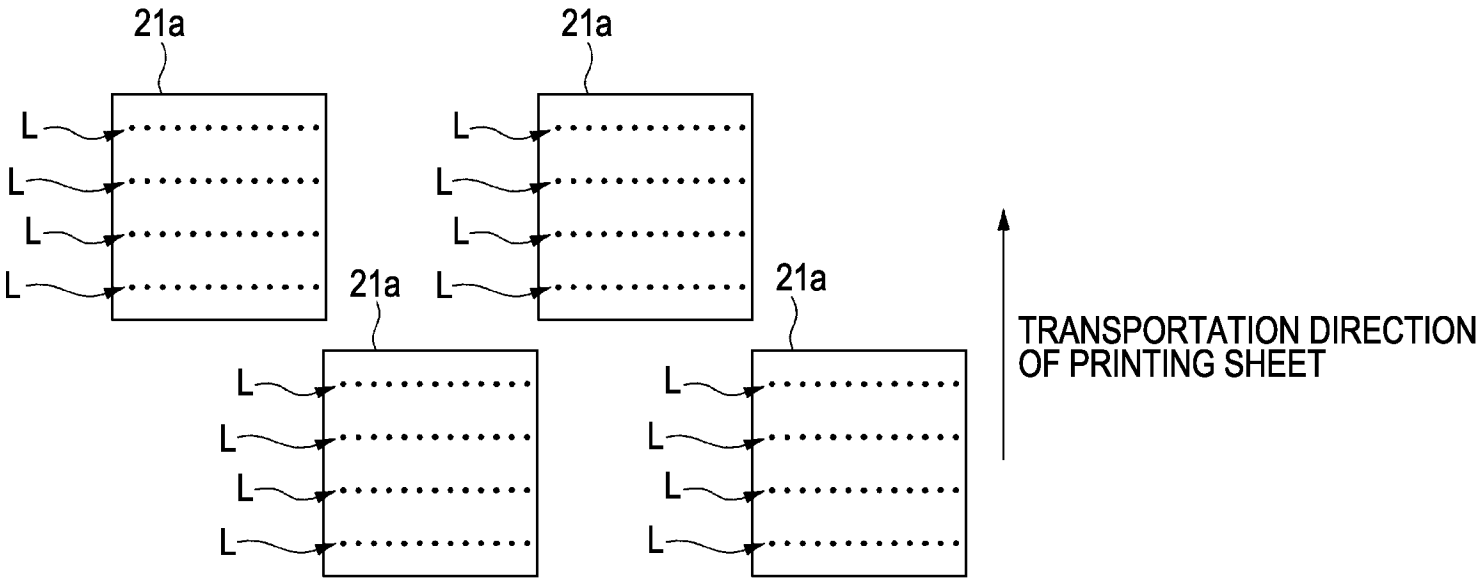
FIG. 9 is a schematic diagram illustrating a modified example of the printing head of the printer of the first embodiment of the invention.

For example, in the above-described embodiment, a configuration has been described in which a single line head is provided as the printing head 21. However, the invention is not limited thereto, and a plurality of heads may be arranged throughout the effective printing width of the plurality of heads. At this time, as shown in FIG. 9, it is not necessary for the plurality of heads 21*a* to be arranged in a line, rather they may be arranged in a zigzag pattern.

Similarly, when the plurality of heads 21*a* is arranged in zigzag, the plurality of nozzle rows is arranged at the same position in the extension direction of the nozzle row (the transportation direction of the printing sheet). However, since the plurality of nozzle rows disposed at the same position in the extension direction of the nozzle row is regarded as one nozzle row during the flushing process, it is possible to perform the flushing process in accordance with the same control as in the embodiment.

Further, a cleaning mechanism cleaning the absorbing member 12 may be provided in the printer of the above-described embodiment. In this case, when the cleaning mechanism is disposed on the downstream side of the movement direction of the absorbing member 12 (the downstream side of the pulley 20B), it is possible to perform a cleaning process of cleaning the absorbing member 12 having the ink absorbed thereto. When the cleaned and recycled absorbing member 12 is wound on the rotation portion 16, and for example, the rotation portions 15 and 16 are rotated in the reverse direction, it is possible to perform the flushing process again.

In the above-described embodiments, the configuration is described in which the absorbing members 12 extend in parallel to the extension direction of the nozzle rows. However, the invention is not limited thereto, and the extension direction of the absorbing members 12 may not be perfectly parallel to the extension direction of the nozzle rows. That is, in the invention, the meaning that the absorbing members extend along the extension direction of the nozzle rows includes the case where the extension line extending in the extension direction of the nozzle rows intersects the extension line extending in the extension direction of the absorbing members in the front region as well as the case where the extension direction of the absorbing members is perfectly parallel to the extension direction of the nozzle rows.

Hereafter, FIGS. 10A to 10D sequentially illustrate the configuration and the operation of the flushing unit of the printer in which the absorbing member is suspended at a predetermined angle with respect to the nozzle row. In addition, the description of the same configuration as that of the printer shown in FIG. 1 will be omitted.

Figure 11:
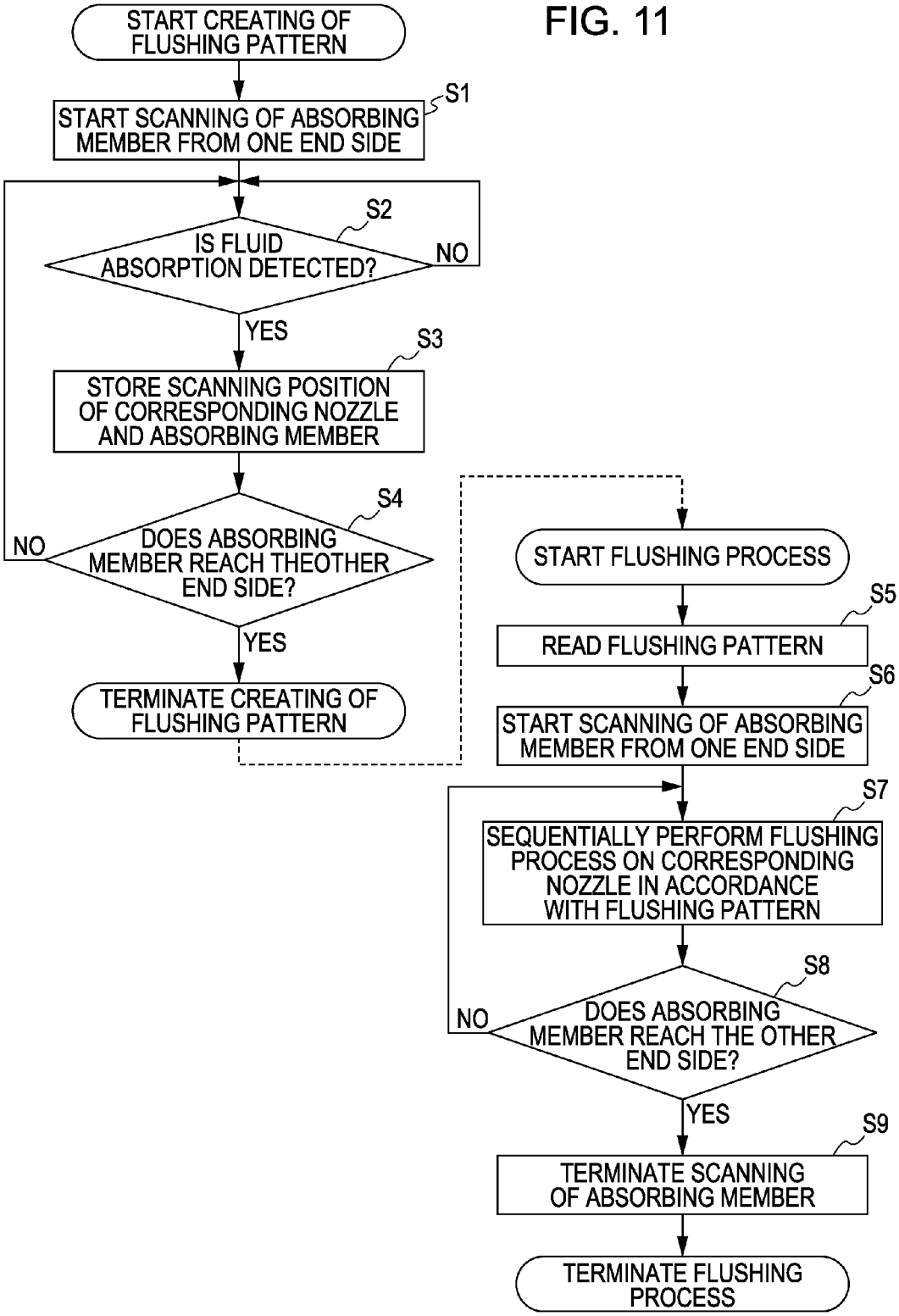
FIG. 11 is a flowchart illustrating the flushing process of the printer of still another embodiment of the invention.

Further, FIG. 11 illustrates a flowchart of the flushing process of the embodiment.

A flushing unit 71 of the printer shown in FIGS. 10A to 10D includes a linear absorbing member 72 which absorbs the ink ejected during the flushing process and a support mechanism 73 which supports the absorbing member 72. In addition, a printing head 81 has the nozzle rows (L(Y), L(M), L(C), and L(Bk)) formed by the arranged nozzles 74 of respective colors.

The absorbing member 72 is held inside a guide groove that is formed by a shaft portion 80*a* and a projection portion 80*b* of pulleys 80A and 80B respectively provided on both sides of the printing head 81 in the extension direction of the nozzle row L. Also, the absorbing member 72 is suspended between the pulleys 80A and 80B in the suspension direction Q that is inclined at a predetermined angle with respect to the extension direction of the nozzle row L. In addition, the pulleys 80A and 80B constitute a movement mechanism 75 (a first movement section) that moves the absorbing member 72 in the direction R intersecting the extension direction of the nozzle row.

In the printer with such a configuration, a relationship between the absorbing member 72 moving along the direction R and the nozzles 74 (the absorbing member 72 overlapping with the fluid ejecting direction of the nozzle 74) sequentially facing the absorbing member 72 in accordance with the movement is first stored before performing the flushing process. The printer controls the ejection of each of the nozzles 74 during the flushing process on the basis of a flushing pattern (ejection timing data) storing the ejection timing for each of the nozzles in accordance with the movement of the absorbing member.

The sequence of creating the flushing pattern (the ejection timing data) is as below. First, the absorbing member 72 moves at a constant speed from one end side to the other end side in the direction R intersecting the extension direction of the nozzle row of the printing head 81 without stopping on the way (FIG. 11: S1 and S4). Simultaneously, the flushing process is performed on all nozzles 74, and a flushing pattern representing the relationship between the position of the absorbing member 72 and the nozzles ejecting the absorbed fluid (ink) is stored.

As a method of detecting a timing that the fluid ejected from a specific nozzle is absorbed to the absorbing member 72, that is, a specific nozzle overlaps with the absorbing member 72 moving at a constant speed, for example, a method of detecting the induced voltage generated by the electrostatic induction may be exemplified.

Figure 12A:
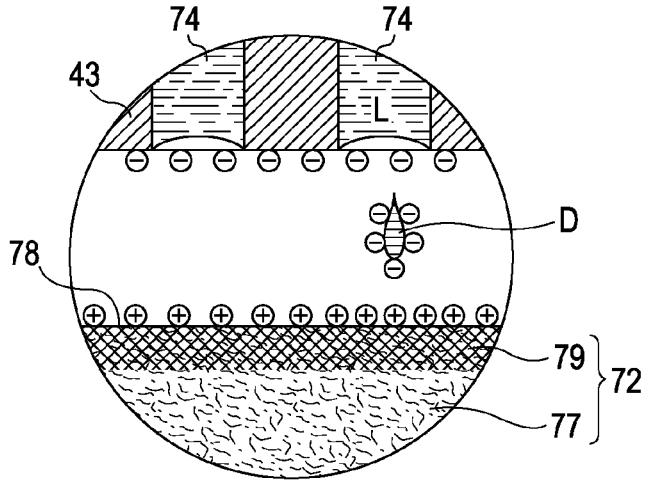
FIGS. 12A and 12B are explanatory diagrams illustrating an example of a method of detecting a fluid absorption state of the printer of still another embodiment of the invention.
Figure 12B:
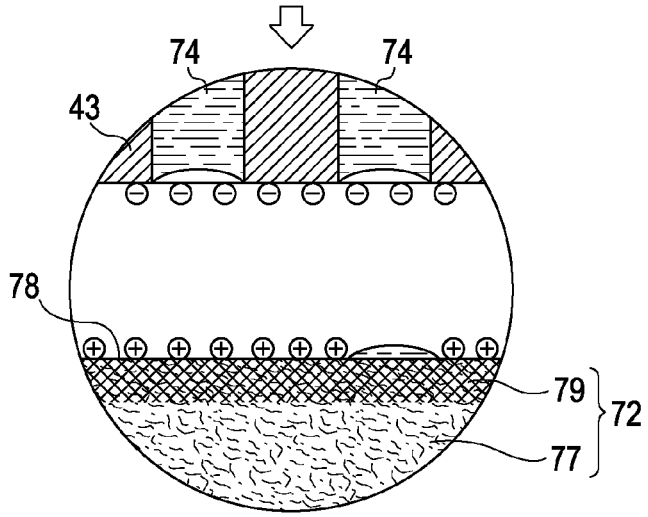

FIGS. 12A and 12B are explanatory diagrams illustrating a method of detecting whether the fluid is absorbed to the absorbing member 72 by using the induced voltage generated by the electrostatic induction. That is, FIG. 12A illustrates a state immediately after the fluids (the ink droplets D) are ejected, and FIG. 12B illustrates a state where the ink droplets D are landed (absorbed) on the absorbing member 72.

For example, the absorbing member 72 is formed by weaving an electrical conductor 79 such as a thin wire in a fiber-like base 77. When the ink droplet D is ejected from a certain nozzle 74, a part of negative charges of the nozzle 74 charged to negative polarity moves to the ink droplet D, and the ejected ink droplet D is charged to be negative. Then, as the ink droplet D approaches the electrical conductor 79 woven in the absorbing member 72, the amount of positive charge increases in the surface 78 of the electrical conductor 79 due to electrostatic induction.

Figure 13:
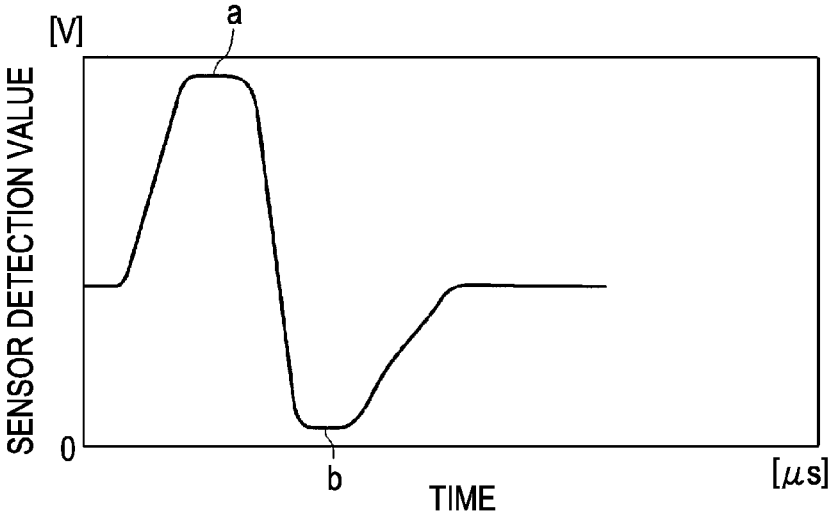
FIG. 13 is a graph illustrating a variation in the voltage of FIGS. 12A and 12B.

Accordingly, as shown in FIG. 13, the voltage between the nozzle 74 and the electrical conductor 79 becomes higher than the initial voltage value when the ink droplet D is not ejected (area a of FIG. 13), due to the induced voltage generated by the electrostatic induction.

Subsequently, when the ink droplet D is landed on the absorbing member 72 as shown in FIG. 12B, the positive charges of the electrical conductor 79 are neutralized by the negative charges of the ink droplet D. For this reason, the voltage between the nozzle 74 and the electrical conductor 79 becomes lower than the initial voltage value (the area b of FIG. 13).

Then, the voltage between the nozzle 74 and the electrical conductor 79 return to the initial voltage value. Accordingly, as shown in FIG. 13, in the detection waveform output from an ink droplet sensor 7, the voltage first increases, decreases to the voltage value lower than the initial voltage value, and then returns to the initial voltage value.

When a variation in the waveform is detected by the voltage sensor (FIG. 11: S2), it is possible to detect whether the ink droplet D ejected from each of the nozzles 74 is landed (absorbed) on the absorbing member 72, that is, the timing that a certain nozzle overlaps with the absorbing member 72 moving at a constant speed. Thus, the position of the absorbing member 72 corresponding to the nozzle 74 in the direction R is referenced (FIG. 11: S3).

According to the above-described sequence, the flushing pattern (the ejection timing data) storing the timing that the absorbing member 72 overlaps with all nozzles 74 of the printing head 81 is created.

Subsequently, the flushing pattern (the ejection timing data) created in the above-described sequence is read first during the flushing process using the flushing unit 71 (FIG. 11: S5).

Figure 10A:
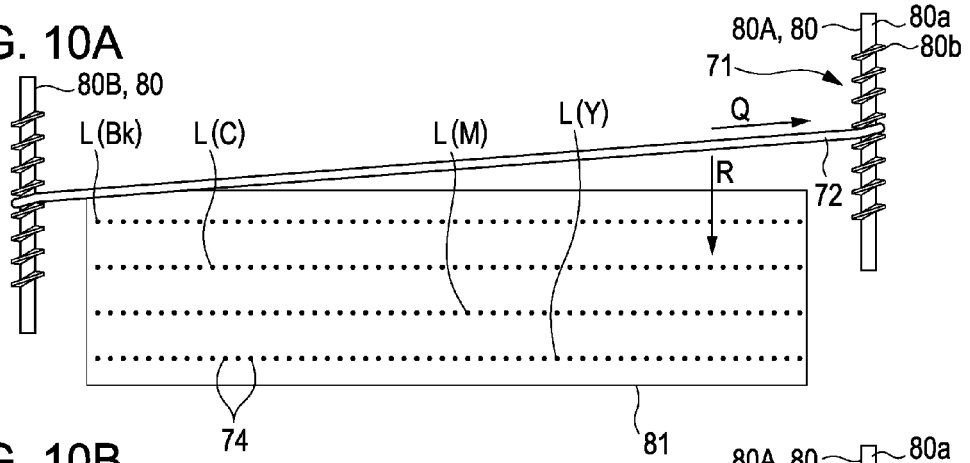
FIGS. 10A to 10D are explanatory diagrams illustrating the flushing process of the printer of another embodiment of the invention.
Figure 10B:
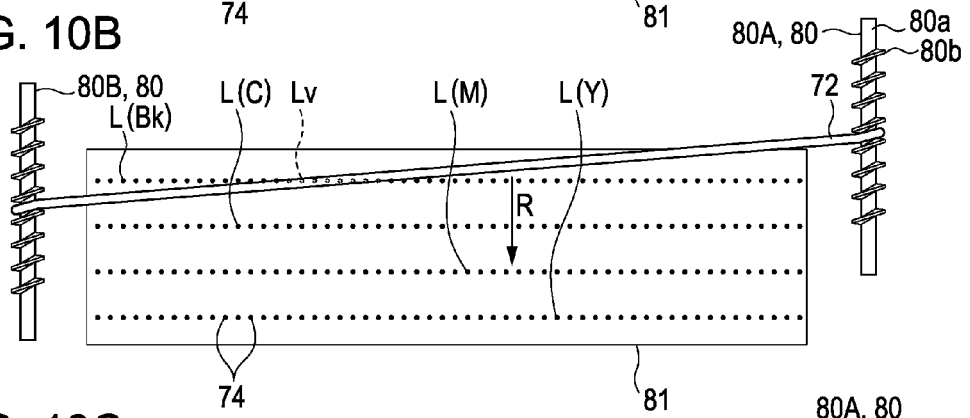
Figure 10C:
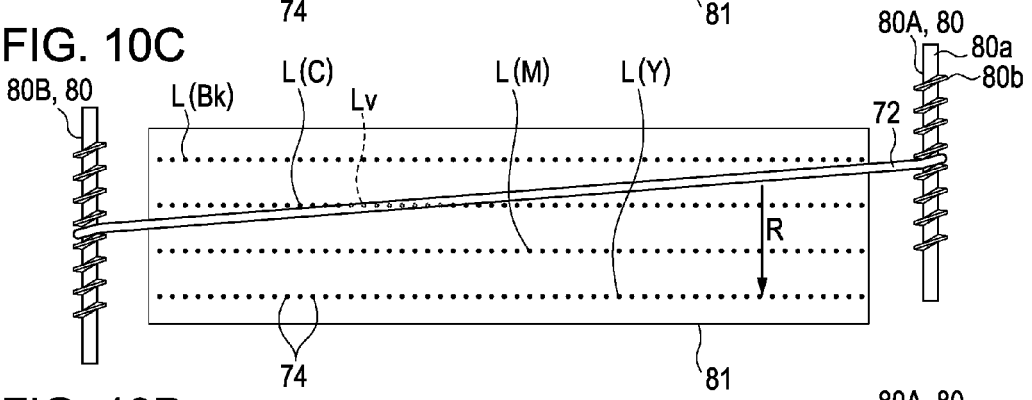
Figure 10D:
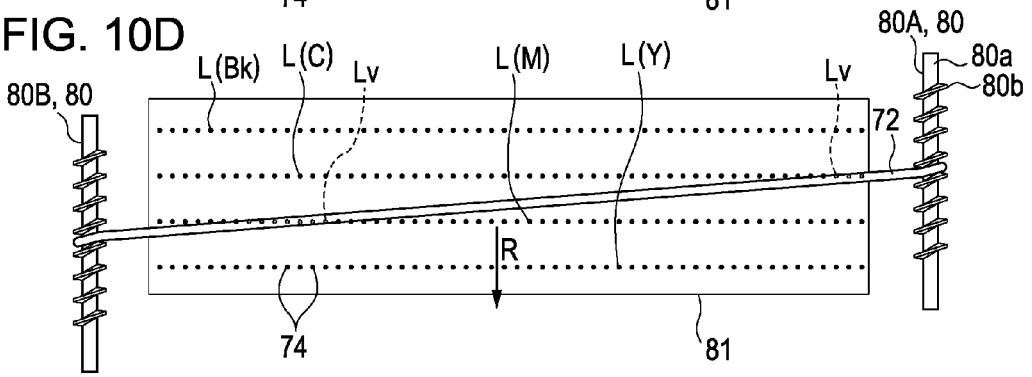

Subsequently, as shown in FIG. 10A, the absorbing member 72 suspended while being inclined at a predetermined angle with respect to the extension direction of the nozzle row L moves (scans) at a constant speed from one end side to the other end side in the scanning direction R without stopping on the way (FIG. 11: S6). The read flushing pattern is normally referenced while the scanning operation of the absorbing member 12 is performed, and the flushing process is sequentially performed on the nozzles Lv located at a position overlapping with the absorbing member 72 (FIG. 11: S7). Then, the fluid (ink droplet) ejected from the nozzles Lv is absorbed to the absorbing member 72 (FIGS. 10B to 10D).

Thus, when the absorbing member 72 reaches the retreat position as the other end side in the scanning direction R (FIG. 11: S8), the absorbing member 12 stops (FIG. 11: S9).

Similarly, when the absorbing member 72 is suspended while being inclined at a predetermined angle with respect to the extension direction of the nozzle row L, it is possible to suppress the occurrence of jams due to the contact between the end portion of the printing sheet 8 and the absorbing member 12.

Further, when the flushing pattern (the ejection timing data) storing the ejection timing for all nozzles in accordance with the movement of the absorbing member is stored in advance, and the ejection control of each of the nozzles 74 is performed by referring to the flushing pattern during the flushing process, it is possible to flexibly handle various nozzle arrangements of the printing heads when the arrangement of the nozzle rows is changed.

In the above-described embodiments, a configuration is described in which the invention is applied to the line head type printer. However, the invention is not limited thereto, but may be applied to a serial type printer.

In the above-described embodiments, a configuration is described in which the absorbing members 12 always move right below the head 21. However, the invention is not limited thereto, but may adopt a configuration in which the absorbing members 12 move to a region (for example, a region on the side portions of the head 21) deviated from the positions right below the head 21 upon retracting the absorbing members 12.

Alternatively, the absorbing member may move to the side of the transportation belt 33 or the like that is away from the transportation path in the printing head. Accordingly, since the absorbing member does not contact the printing medium, it is possible to prevent the printing medium from being contaminated by the absorbed ink. Further, in the case where the absorbing member is located between the transportation path and the printing head, when the portion not absorbing the ink is located therebetween by the winding mechanism 13, it is possible to prevent the printing medium from being contaminated.

In the above-described embodiments, a configuration is adopted in which a positional relationship between the absorbing members 12 and the head 21 is changed by moving the absorbing members 12. However, the invention is not limited thereto, but a configuration may be adopted in which a positional relationship between the absorbing members 12 and the head 21 is changed by moving the head 21.

However, when both the printing head and the absorbing member need to move, they are made to relatively move, and the movement direction or the movement speed thereof is, of course, changed.

In the above-described embodiments, an ink jet printer is adopted, but a fluid ejecting apparatus for ejecting a fluid other than ink or a fluid container for storing the fluid may be adopted. Various fluid ejecting apparatuses including a fluid ejecting head for ejecting a minute amount of liquid droplet may be adopted. In addition, the liquid droplet indicates the fluid ejected from the fluid ejecting apparatus, and includes a liquid having a particle shape, a tear shape, or a linear shape. Further, here, the fluid may be a material which can be ejected from the liquid ejecting apparatus.

For example, a liquid-state material may be used, including a liquid-state material such as sol or gel water having a high or low viscosity, a fluid-state material such as an inorganic solvent, an organic solvent, a liquid, a liquid-state resin, or liquid-state metal (metallic melt), and a material in which a functional material having a solid material such as pigment or metal particle is dissolved, dispersed, or mixed with a solvent in addition to a fluid. In addition, ink or liquid crystal described in the embodiments may be exemplified as a typical example of the fluid. Here, the ink indicates general water-based ink, oil-based ink, gel ink, or hot-melt ink which contains various fluid compositions.

As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precise pipette, a silkscreen printing apparatus, or a micro dispenser may be used.

In addition, a fluid ejecting apparatus for ejecting lubricant from a pinpoint to a precision machine such as a watch or a camera, a fluid ejecting apparatus for ejecting a transparent resin liquid such as a UV-curing resin onto a substrate in order to form a minute hemispherical lens (optical lens) used for an optical transmission element or the like, or a fluid ejecting apparatus for ejecting an etching liquid such as an acid liquid or an alkali liquid in order to perform etching on a substrate or the like may be adopted. Further, the invention may be applied to any one of the fluid ejecting apparatuses and a fluid container thereof.

What is claimed is:

1. A fluid ejecting apparatus comprising:

a plurality of nozzle rows which are arranged in a direction intersecting a nozzle row direction of a nozzle row formed by arranging nozzles in a line;

an absorbing member which is suspended and extends along the nozzle row direction or inclined with respect to the nozzle row direction at a predetermined angle, and wherein the absorbing member is adapted to move in a suspension direction that is along the row direction, wherein the length of the absorbing member extends in the suspension direction;

a first movement section which relatively moves at least one of the absorbing member and the nozzle rows in the direction intersecting the nozzle row direction and perpendicular to the length of the absorbing member;

a second movement section which moves the absorbing member in the suspension direction thereof, wherein the second movement section includes a rotation body capable of winding the absorbing member thereon;

a medium holding member which holds a medium having a predetermined gap with respect to the nozzles in an ejection direction in which the fluid is ejected from the nozzles toward the medium; and a control section which performs a flushing process in which a fluid is selectively ejected from the nozzles facing the absorbing member toward the absorbing member while moving the absorbing member using the first movement section, wherein the absorbing member is located having a gap with respect to the medium holding member in the ejection direction when the fluid is ejected from the nozzles toward the absorbing member.

2. The fluid ejecting apparatus according to claim 1, wherein the number of absorbing members is fewer than the number of nozzle rows.

3. The fluid ejecting apparatus according to claim 2, further comprising:

a detection section which detects the nozzles facing the absorbing member, wherein the control section controls the ejection of each of the nozzles during the flushing process on the basis of ejection timing data created in advance by the detection section and storing the ejection timing for each of the nozzles.

4. The fluid ejecting apparatus according to claim 2, further comprising:

a detection section which detects the nozzles facing the absorbing member, wherein the control section outputs position information of the nozzles sequentially facing the absorbing member during the flushing process, and wherein the control section selectively ejects the fluid only from the nozzles facing the absorbing member on the basis of the position information output from the detection section in real time.

5. The fluid ejecting apparatus according to claim 1, wherein the absorbing member is disposed within the predetermined gap between the nozzles and the medium holding member.

6. The fluid ejecting apparatus according to claim 1, wherein the absorbing member is disposed closer to the nozzles than the medium held by the medium holding member.

7. The fluid ejecting apparatus according to claim 1, wherein the absorbing member has a length and a width that is less than the length thereof and less than a spacing between two adjacent rows.

8. The fluid ejecting apparatus according to claim 1, wherein the absorbing member has a length and peripheral edges extending along a width that is less than the length thereof, the peripheral edges being spaced apart less than a spacing between adjacent nozzle rows.

9. The fluid ejecting apparatus according to claim 1, wherein the suspension direction is transverse to a transportation direction of a medium transported past the plurality of nozzle rows.

* * * * *